US010689871B2

(12) United States Patent
Desjoyaux et al.

(10) Patent No.: US 10,689,871 B2
(45) Date of Patent: Jun. 23, 2020

(54) MODULAR PANEL FOR POOL WALLS AND CORRESPONDING POOL

(71) Applicant: PISCINES DESJOYAUX SA, La Fouillouse (FR)

(72) Inventors: Jean-Louis Desjoyaux, Chalain le Comtal (FR); Jacky Tripier, Saint Marcellin en Forez (FR)

(73) Assignee: Piscines Desjoyaux Sa, La Fouillouse (FR)

( * ) Notice: Subject to any disclaimer, the term of this patent is extended or adjusted under 35 U.S.C. 154(b) by 0 days.

(21) Appl. No.: 16/314,115

(22) PCT Filed: Jun. 30, 2017

(86) PCT No.: PCT/FR2017/051768
§ 371 (c)(1),
(2) Date: Dec. 28, 2018

(87) PCT Pub. No.: WO2018/002552
PCT Pub. Date: Jan. 4, 2018

(65) Prior Publication Data

US 2019/0218802 A1 Jul. 18, 2019

(30) Foreign Application Priority Data

Jul. 1, 2016 (FR) ..... 16 56311

(51) Int. Cl.
*E04H 4/00* (2006.01)
*E04G 9/05* (2006.01)
*E04G 9/10* (2006.01)

(52) U.S. Cl.
CPC ..... *E04H 4/0081* (2013.01); *E04G 9/05* (2013.01); *E04G 9/10* (2013.01)

(58) Field of Classification Search
CPC ... E04H 4/0081; E04H 4/0087; E04H 4/0093; E04G 9/05; E04G 9/10; E04G 2009/028
See application file for complete search history.

(56) References Cited

U.S. PATENT DOCUMENTS 2,873,505 A * 2/1959 Sheldon ..... E04G 11/062 264/34
3,479,786 A * 11/1969 Kreier, Jr. ..... B28B 15/00 52/745.2

(Continued)

FOREIGN PATENT DOCUMENTS

| | | |
|---|---|---|
| EP | 0382649 A1 | 8/1990 |
| FR | 2765909 A1 | 1/1999 |
| FR | 2829788 A1 | 3/2003 |

OTHER PUBLICATIONS

International Written Opinion for International Application No. PCT/FR2017/051768 dated Oct. 9, 2017, 5 pages.

(Continued)

*Primary Examiner* — Michael Safavi
(74) *Attorney, Agent, or Firm* — TraskBritt

(57) ABSTRACT

A modular panel made of plastic material for manufacturing pool walls comprises: a generally rectangular main body of which a first surface is intended for being oriented toward the inside of the pool, the lengths of the main body defining a reference plane; a complementary body capable of being attached to a second surface of the main body and defining a hollow column intended for receiving concrete, wherein the first surface has an initial convex transverse curve on the width of the main body in a plastic injection mold, the maximum amplitude of the transverse curve relative to the reference plane being selected to compensate for all or part of the deformations that occur between the removal from the mold and the setting of the concrete, in the transverse and longitudinal directions.

8 Claims, 3 Drawing Sheets

(56) References Cited

U.S. PATENT DOCUMENTS

| | | | | | |
|---|---|---|---|---|---|
| 4,090,266 | A * | 5/1978 | Price | E04H 4/0081 | 52/169.7 |
| 4,093,689 | A * | 6/1978 | Mayer | B28B 23/046 | 264/228 |
| 5,074,095 | A * | 12/1991 | Wilnau | B28B 11/003 | 264/261 |
| 5,111,628 | A * | 5/1992 | Desjoyaux | E04H 4/0081 | 249/13 |
| 5,184,439 | A * | 2/1993 | Ward | E04C 2/38 | 52/223.6 |
| 6,681,537 | B2 * | 1/2004 | Queirel | E04H 4/0075 | 52/274 |
| 10,344,490 | B1 * | 7/2019 | Foster | E04H 4/0043 | |

OTHER PUBLICATIONS

International Search Report for International Application No. PCT/FR2017/051768 dated Oct. 9, 2017, 2 pages.

* cited by examiner

State of the art

State of the art

MODULAR PANEL FOR POOL WALLS AND CORRESPONDING POOL

CROSS-REFERENCE TO RELATED APPLICATIONS

This application is a national phase entry under 35 U.S.C. § 371 of International Patent Application PCT/FR2017/051768, filed Jun. 30, 2017, designating the United States of America and published as International Patent Publication WO 2018/002552 A1 on Jan. 4, 2018, which claims the benefit under Article 8 of the Patent Cooperation Treaty to French Patent Application Serial No. 1656311, filed Jul. 1, 2016.

TECHNICAL FIELD

The present disclosure relates to the field of structural elements for pools and swimming pools. More specifically, the present disclosure relates to modular panels intended to form the vertical walls in a pool.

BACKGROUND

Building pool walls with identical modular panels assembled together is known.

The documents EP0382649 and FR2765909 disclose generally rectangular modular panels made of plastic material, the width of which (of the order of a few tens of cm) is reduced relative to the height (of the order of 120 cm). The panels comprise a main body having an inner surface that constitutes the inner wall of the pool and an outer surface provided with a vertical, hollow reinforcing element, adapted to receive concrete and to form a vertical column for holding the structure (also called a chimney).

The main body of each modular panel is obtained from plastic injection molds having a planar surface widthwise and lengthwise, to form the inner surface of the main body; the inner surface is expected to be planar after assembling and formwork, to provide a correct planarity of the whole inner wall of the pool.

A defective planarity has, however, been noted in the inner faces of the pool walls built with modular panels of the state of the art, after mounting and formwork thereof. A defective planarity more particularly results in a ripple effect of the inner wall of the pool, which is undesirable for the end user.

BRIEF SUMMARY

One aim of the present disclosure is to provide a modular panel made of plastic material making it possible to obtain a correct planarity of the inner walls of the pool.

The disclosure relates to a modular panel made of plastic material for manufacturing pool walls, comprising:

- a generally rectangular main body of which a first surface is intended for being oriented toward the inside of the pool, with the lengths of the main body defining a reference plane;
- a complementary body capable of being attached to a second surface of the main body and defining a hollow column intended for receiving concrete, wherein, the first surface has an initial convex transverse curve on the width of the main body in a plastic injection mold, with the maximum amplitude of the transverse curve relative to the reference plane being selected to compensate for all or part of the deformations that occur between the removal from the mold and the setting of the concrete, in the transverse and longitudinal directions.

The modular panel according to the disclosure makes it possible to obtain inner pool walls having a correct planarity thanks to the initial convex transverse curve of the panel main body, a first surface of which will form an inner surface of the pool walls. As a matter of fact, the initial convex transverse curve makes it possible to compensate for at least a part of the deformations that occur between the removal from the mold and the setting of the concrete, on the first surface of the main body, in both the transverse and longitudinal directions.

According to advantageous characteristics of the disclosure, taken either separately or in combination:

- the maximum amplitude of the convex curve ranges from 0.2% to 0.7% of the width of the main body;
- the first surface has a null longitudinal curve along the length of the main body, in the plastic injection mold or immediately after the removal thereof from the injection mold;
- the main body comprises longitudinal peripheral wings provided with fastening members for assembling the modular panel with other identical panels;
- the main body comprises locking means that cooperate with complementary means included on the complementary body.

The disclosure also relates to a swimming pool comprising walls comprising a plurality of modular panels as disclosed herein, with the inner faces of the walls having a deviation, with respect to their median planes, of less than 1 mm.

BRIEF DESCRIPTION OF THE DRAWINGS

Other characteristics and advantages of the disclosure will emerge from the detailed description of the disclosure that follows with reference to the appended drawings in which.

DETAILED DESCRIPTION

In the description that follows, the same references in the figures can be used for elements of the same type.

Modular panels made of injected plastic material, having a generally rectangular shape and having a length (along axis z in the figures) and a width (along axis x in the figures) are considered here. The length of the panel defines the height of the pool wall obtained after assembling a plurality of modular panels. The longitudinal direction is the one extending along the panel length and the transverse direction is the one extending along the panel width.

The modular panels considered are formwork panels, i.e., they comprise a longitudinal compartment for casting concrete therein. They further include a first surface 1*a* that matches the inner surface of the pool wall.

Figure 1A:
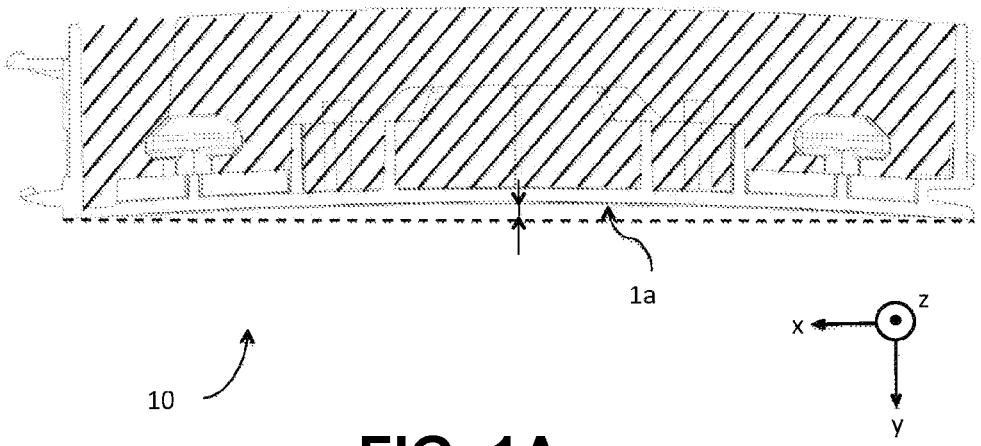
FIGS. 1A and 1B, respectively, show a cross-sectional and a longitudinal view of a modular panel after formwork according to the state-of-the-art.
Figure 1B:
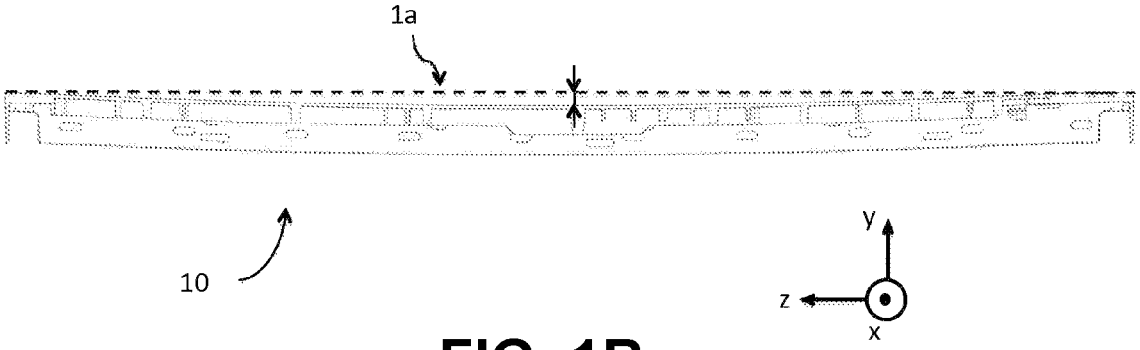

The inner faces of the pool walls built with modular panels 10 of the state of the art, made of plastic material, after mounting and formwork thereof, were noticeably rippled. Such deformations result in a concave curve, i.e., forming a recess at the first surface 1*a* of the panel 10 matching the inner surface of the wall. FIGS. 1A and 1B are, respectively, cross-sectional and longitudinal views illustrating the type of curve noted. The first surface 1*a* of the modular panel 10 of the state-of-the-art is deformed into a concave curve (along the axis y in the figures) in the transverse direction (FIG. 1A) as well as in the longitudinal direction (FIG. 1B).

For example, starting from a first planar surface 1*a*, in the plastic injection mold of a modular panel 10 having a length of 1.2 m and a width of 0.25 m, the transverse concave curve of the first surface 1*a* after formwork may be of the order of 1.5 mm to 2 mm and the longitudinal concave curve may be of the order of 2 mm to 5 mm.

The Applicant noted that adding reinforcing ribs at the back of the first surface 1*a*, which is a logical countermeasure aiming at rigidifying the structure, was not efficient to eliminate such deformations.

After multiple tests, the Applicant determined that the first surface 1*a* of the modular panel 10 was submitted to several mechanical stresses causing successive concave and convex deformations, with various amplitudes, in the transverse and longitudinal directions, with a first deformation causing a concave curve, which occurs after the injected plastic panel has dried, typically 24 hours after removal thereof from the injection mold; with a second deformation causing a convex curve, which occurs upon introducing concrete into the form-work compartment of the panel; eventually, with a third deformation, causing a concave curve, which occurs during the drying of concrete because of the shrinking of the concrete, which substantially heats, thus making the plastic material of the panel 10 more deformable.

From these observations, a modular panel 100 was designed made of plastic material making it possible to eliminate all or part of the ripples noted on the assembled inner walls of a pool.

Figure 2:
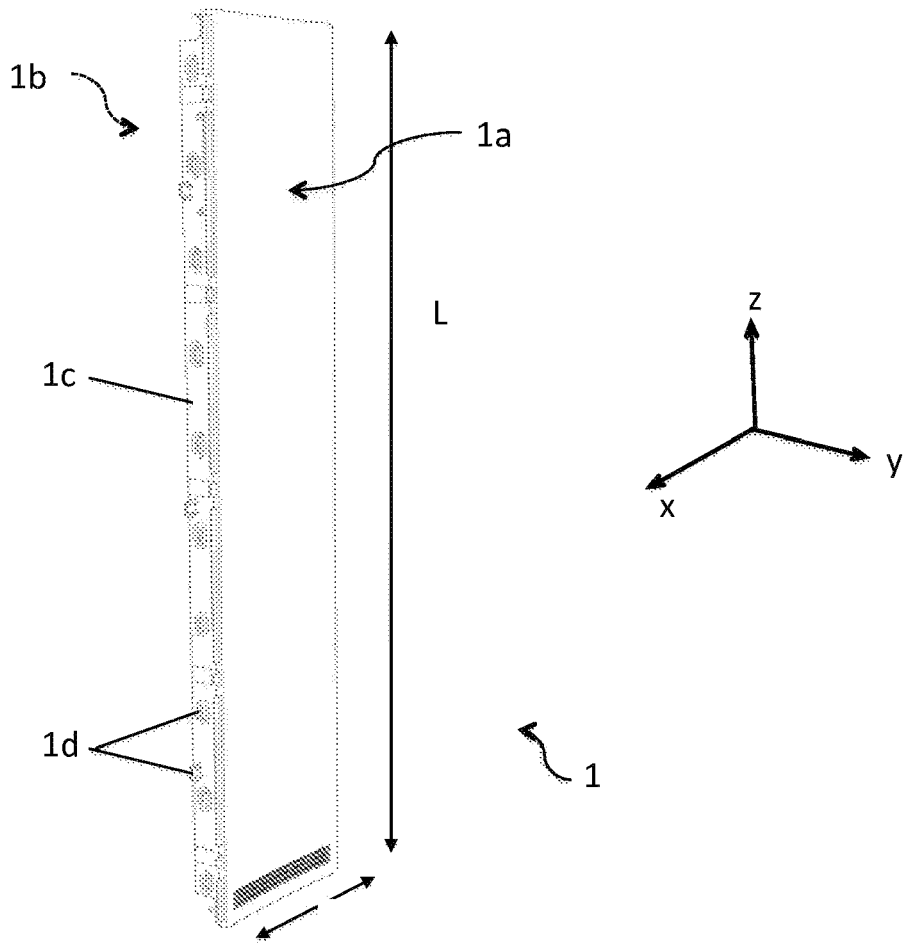
FIG. 2 shows the main body of a modular panel according to the disclosure.

The modular panel 100 according to the disclosure comprises a generally rectangular main body 1, of which a first surface 1*a* is intended for being oriented toward the inside of the pool (FIG. 2). The lengths L of the main body 1 define the height of the pool walls. In the remainder of the text, the longitudinal direction is the one extending along the length L of the main body 1 and the transverse direction is the one extending along the width A of the main body 1. For example, the length L may range from 1 m to 1.5 m; the width A may range from 0.2 m to 0.5 m.

According to the present disclosure, the first surface 1*a* of the main body 1 has a convex transverse curve on the whole width of the main body 1, in the plastic injection mold or immediately after the removal thereof from the injection mold. Conventionally, the convex transverse curve of the main body 1 in the plastic injection mold or immediately after the removal thereof from the injection mold will be referred to as "initial."

Figure 3:
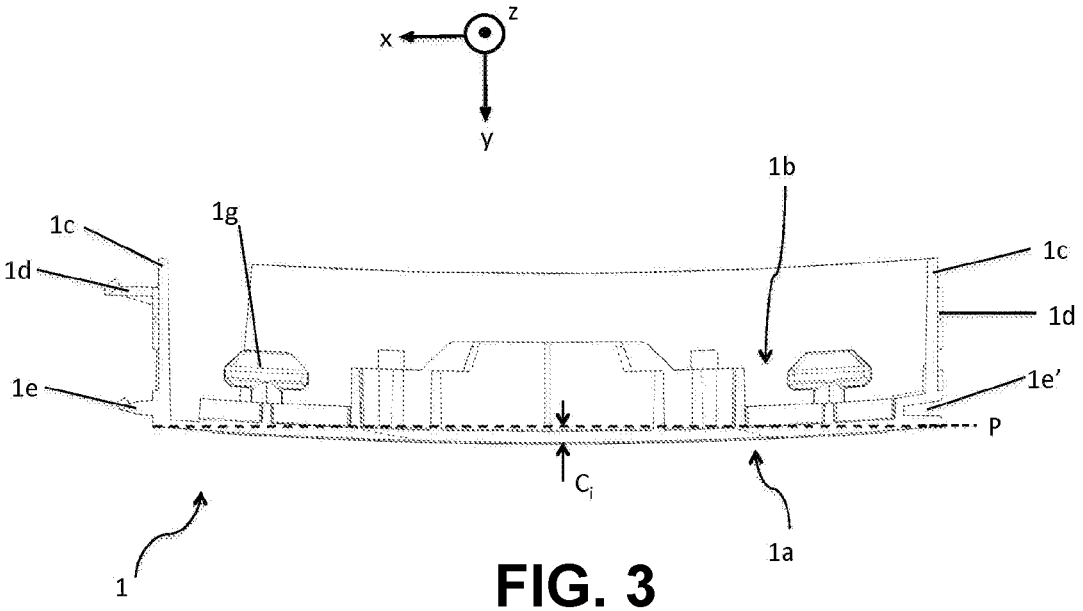
FIG. 3 is a cross-sectional view of a main body of a modular panel according to the disclosure.

Considering a reference plane P defined by the lengths of the main body 1, a convex shape corresponds to a domed curve (as opposed to a recessed curve) of the first surface 1*a*, as shown in FIG. 3. The maximum amplitude, noted Ci, of the initial convex transverse curve of the main body 1 corresponds to the deviation between the reference plane P and a central point on the width A of the main body 1. Such maximum amplitude is selected to compensate for all or part of a deformation that occurs upon setting of concrete. The maximum amplitude of the initial convex transverse curve of the main body 1 advantageously ranges from 0.2% to 0.7% of the width of the main body 1. For example, for a modular panel 100, 1.2 m in length and 0.25 m in width, the initial convex transverse curve of the main body 1 is advantageously of the order of 1.2 mm.

The first surface 1*a* of the main body 1 advantageously has a null or very small longitudinal curve (typically less than 0.4 mm) on the whole length L of the main body 1, in the plastic injection mold.

The main body 1 advantageously comprises longitudinal peripheral wings 1*c*, i.e., extending along the lengths L thereof. The longitudinal wings 1*c* are provided with fastening members 1*d* for assembling the modular panel 100 in pairs (FIG. 3). The fastening members 1*d* can, for instance, be of the snap-fit type or adapted to a screw/nut system.

The longitudinal peripheral wings 1*c* are advantageously also provided with centering and sealing means. They are formed along two longitudinal wings 1*c*, and comprise a male profile 1*e* having a substantially triangular section, and a female profile 1*e'*, having a substantially triangular section, matching the male profile 1*e*. The male 1*e* and female 1*e'* profiles preferably extend on the whole length (height) of the peripheral longitudinal wings 1*c*.

Figure 4:
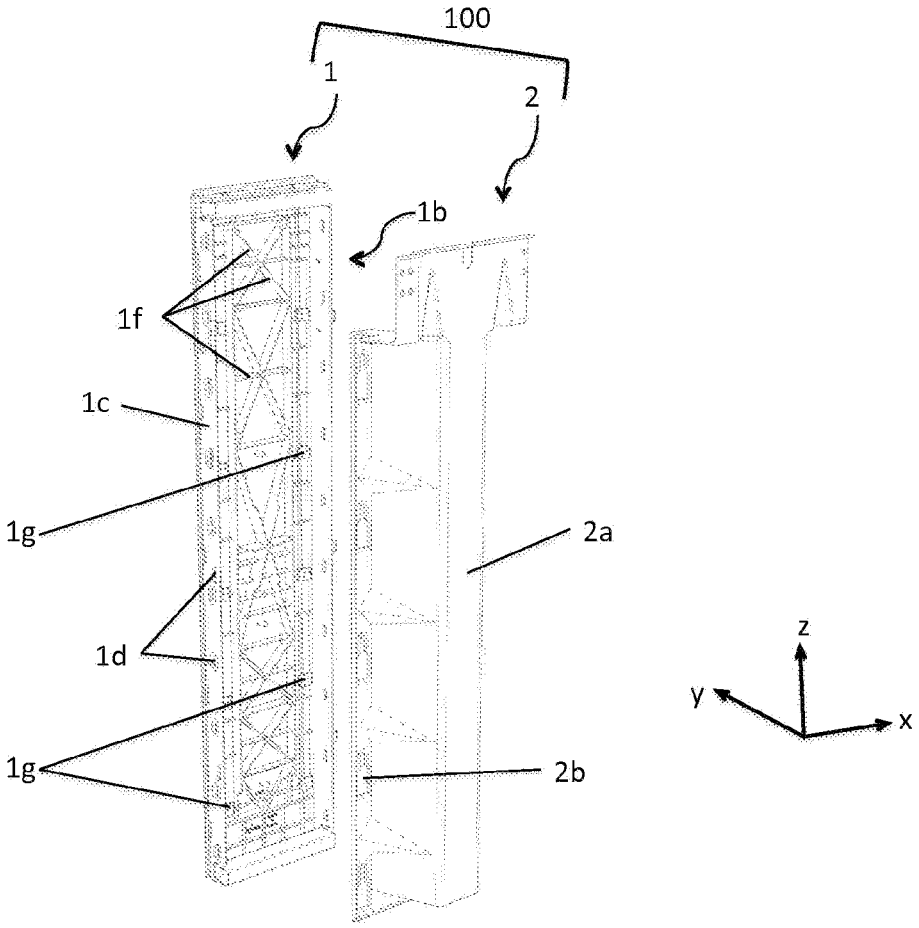
FIG. 4 shows a main body and a complementary body of a modular panel according to the disclosure.

The main body 1 preferably includes reinforcing ribs 1*f* on a second surface 1*b* thereof (FIG. 4). These may extend along the whole length L. They may also form a meshing, if they also extend on the whole, or a part of the width A thereof.

The modular panel 100 also comprises a complementary body 2 capable of being attached to the second surface 1*b* of the main body 1 and defining a hollow column 2*a* intended for receiving concrete therein (FIG. 4). The main body 1 thus advantageously includes locking means 1*g*, which cooperate with complementary means 2*b* included on the complementary body 2. For example, the locking means 1*g* may consist of snugs, the free ends of which comprise a shoulder. The complementary means 2*b* consist in bottlenecked holes. The shoulders on the snugs are first inserted into the widest parts of the holes; the complementary body 2 is then pressed against the second surface 1*b* of the main body 1. Eventually, a downstream longitudinal movement of the complementary body 2 makes it possible to wedge the snugs in the bottlenecked parts of the holes; the shoulders of the snugs, which are wider than the bottlenecked parts, make it possible to lock the complementary body 2 on the main body 1.

The main body 1 and the complementary body 2 are made of plastic material and are produced by injecting and molding a thermosetting plastic material as mentioned above. For example, the thickness of the main body 1 in the part the first 1*a* and second 1*b* surfaces are made is of the order of 2 mm to 3 mm.

To produce the pool walls, a plurality of modular panels 100 can be assembled into a closed outline. The inner surface of the pool walls consists of all the first surfaces 1*a* of the main bodies 1 of the plurality of modular panels 100. When such assembling is complete, material such as concrete is cast into the hollow column 2*a* of each modular panel 100.

The initial convex transverse curve of the first surface 1*a* of the main body 1 of the modular panel 100 makes it possible to compensate for at least a portion of the deformations that occur between the removal from the mold and the setting of the concrete, in the transverse direction and, quite surprisingly, in the longitudinal direction. The amplitude of the initial convex transverse curve depends, among other things, on the dimensions of the panel but can be easily determined by producing a reduced number of prototypes.

For example, starting from a first surface 1*a* having an initial convex transverse curve (in the plastic injection mold)

of 1.2 mm and a null initial longitudinal curve, of a modular panel 100, 1.2 m in length and 0.25 m in width, the first surface 1*a*, when concrete is dry, is planar or substantially planar in the transverse and longitudinal directions. Substantially planar means a transverse longitudinal curve of less than 1 mm, advantageously less than 0.5 mm.

The swimming pool according to the disclosure comprises walls formed of a plurality of modular panels 100; the inner surfaces of the walls thus have a deviation with respect to their median planes of less than 1 mm. The median plane of an inner surface of a wall can be defined by the plane passing through the 4 corners of the substantially rectangular shape of the inner surface. The deviation in the transverse direction and the deviation in the longitudinal direction of the inner surface (corresponding to each first surface 1*a* of a main body 1 of the assembled modular panels 100) are of less than 1 mm. The deviations are advantageously of less than 0.5 mm.

Of course, the disclosure is not limited to the embodiments described and alternative embodiments can be provided within the scope of the invention as defined by the claims.

The invention claimed is:

1. A modular plastic panel for manufacturing pool walls, comprising:

a plastic injection molded and generally rectangular main body having a first surface configured for being oriented toward the inside of the pool, lengths of the main body on opposing lateral sides of the main body defining a reference plane; and a complementary body configured for attachment to a second surface of the main body and defining a hollow column for receiving concrete therein;

wherein the first surface has an initial convex transverse curve on a width of the main body between the opposing lateral sides of the main body upon removal of the generally rectangular main body from a plastic injection mold used to form the generally rectangular main body, a maximum amplitude of the initial convex transverse curve relative to the reference plane being selected to compensate for at least a portion of deformation of the main body that occurs in the transverse and longitudinal directions upon setting of concrete in the hollow column;

wherein the maximum amplitude of the initial convex transverse curve is in a range extending from 0.2% to 0.7% of the width of the main body.

2. The modular panel of claim 1, wherein the first surface has a null initial longitudinal curve along the length of the main body.

3. The modular panel of claim 2, wherein the main body comprises longitudinal peripheral wings provided with fastening members for assembling the modular panel with other identical panels.

4. The modular panel according to claim 3, wherein the main body comprises locking features that cooperate with complementary features of the complementary body.

5. A swimming pool comprising walls comprising a plurality of modular panels according to claim 4, the inner faces of the walls having a deviation of less than 1 mm with respect to their reference planes.

6. The modular panel of claim 1, wherein the main body comprises longitudinal peripheral wings provided with fastening members for assembling the modular panel with other identical panels.

7. The modular panel of claim 1, wherein the main body comprises locking features that cooperate with complementary features of the complementary body.

8. A swimming pool comprising walls comprising a plurality of modular panels according to claim 1, the inner faces of the walls having a deviation of less than 1 mm with respect to their reference planes.

* * * * *